US007168959B2

(12) United States Patent
Kuo et al.

(10) Patent No.: US 7,168,959 B2
(45) Date of Patent: Jan. 30, 2007

(54) ELECTRICAL CONNECTOR WITH SUPPORT ELEMENT

(75) Inventors: Wei Nan Kuo, Tu-Cheng (TW); Jen-Jou Chang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/293,976

(22) Filed: Dec. 5, 2005

(65) Prior Publication Data

US 2006/0121756 A1 Jun. 8, 2006

(30) Foreign Application Priority Data

Dec. 4, 2004 (CN) ..... 2004 2 0054134

(51) Int. Cl.
*H01R 12/00* (2006.01)

(52) U.S. Cl. ..... 439/67; 439/607

(58) Field of Classification Search ..... 439/67, 439/71, 76.1, 607

See application file for complete search history.

(56) References Cited

U.S. PATENT DOCUMENTS

| | | | | |
|---|---|---|---|---|
| 5,797,771 | A * | 8/1998 | Garside | 439/610 |
| 6,206,728 | B1 * | 3/2001 | Krehbiel et al. | 439/607 |
| 6,877,995 | B1 * | 4/2005 | Chen | 439/76.1 |
| 6,932,623 | B2 * | 8/2005 | Lai | 439/76.1 |
| 6,939,172 | B2 * | 9/2005 | Lu | 439/607 |
| 2004/0068868 | A1 | 4/2004 | Nishio | |

* cited by examiner

*Primary Examiner*—Thanh-Tam Le
(74) *Attorney, Agent, or Firm*—Wei Te Chung

(57) ABSTRACT

An electrical connector for receiving a module (200) includes a shield (10, 11) defining a receiving space (104) for receiving the module, an FPC (3) received in the receiving space for electrically connecting the module and a support element connected to the FPC for maintaining an electrical connection between the FPC and the module.

12 Claims, 7 Drawing Sheets

ELECTRICAL CONNECTOR WITH SUPPORT ELEMENT

BACKGROUND OF THE INVENTION

1. Field of the Invention

The present invention relates to an electrical connector, and more particularly to an electrical connector for mounting a camera module.

2. Description of the Prior Art

With development of cellular mobile phones or the likes, a lot of additional functions such as taking pictures etc. are added to the mobile phones or the likes. In order to achieve functions such as taking pictures etc., camera modules are furnished to the mobile phones or the likes in virtue of electrical connectors.

An electrical connector for connecting a camera module to a circuit board is disclosed in U.S. application No. 2004/0068868. Such electrical connector comprises a square insulative housing and a plurality of conductive terminals. The insulative housing comprises a plurality of receiving slots on inside wall for receiving the conductive terminals. The camera module is retained in the insulative housing and electrically contacts with the conductive terminals. It is the disadvantage of the electrical connector that too much space of an electrical device are occupied by the insulative housing.

China patent No. 1479506A discloses another electrical connector. This electrical connector comprises a FPC (Flexible Printed Circuit) that defines one end soldering with a camera module, and another end connected with the circuit board of an electrical device. This art does not provide an insulative housing. However, assembling the camera module onto the FPC directly results in some problems. Specially, maintaining the electrical connector or changing the camera module needs to destroy a soldering portion formed between the camera module and the FPC. In addition, this electrical connector dose not provide a shielding. Therefore, this disadvantage results in poor anti-EMI (Electro Magnetic Interference) ability.

Hence, an improved electrical connector is needed to solve the above problems.

BRIEF SUMMARY OF THE INVENTION

An object of the invention is to provide an electrical connector occupying small space.

Another object of the invention is to provide an electrical connector having a good anti-EMI function.

In order to attain the object above mentioned, an electrical connector for receiving a module, includes a shield defining a receiving space for receiving the module, an FPC received in the receiving space for electrically connecting the module and a support element connected to the FPC for maintaining an electrical connection between the FPC and the module.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
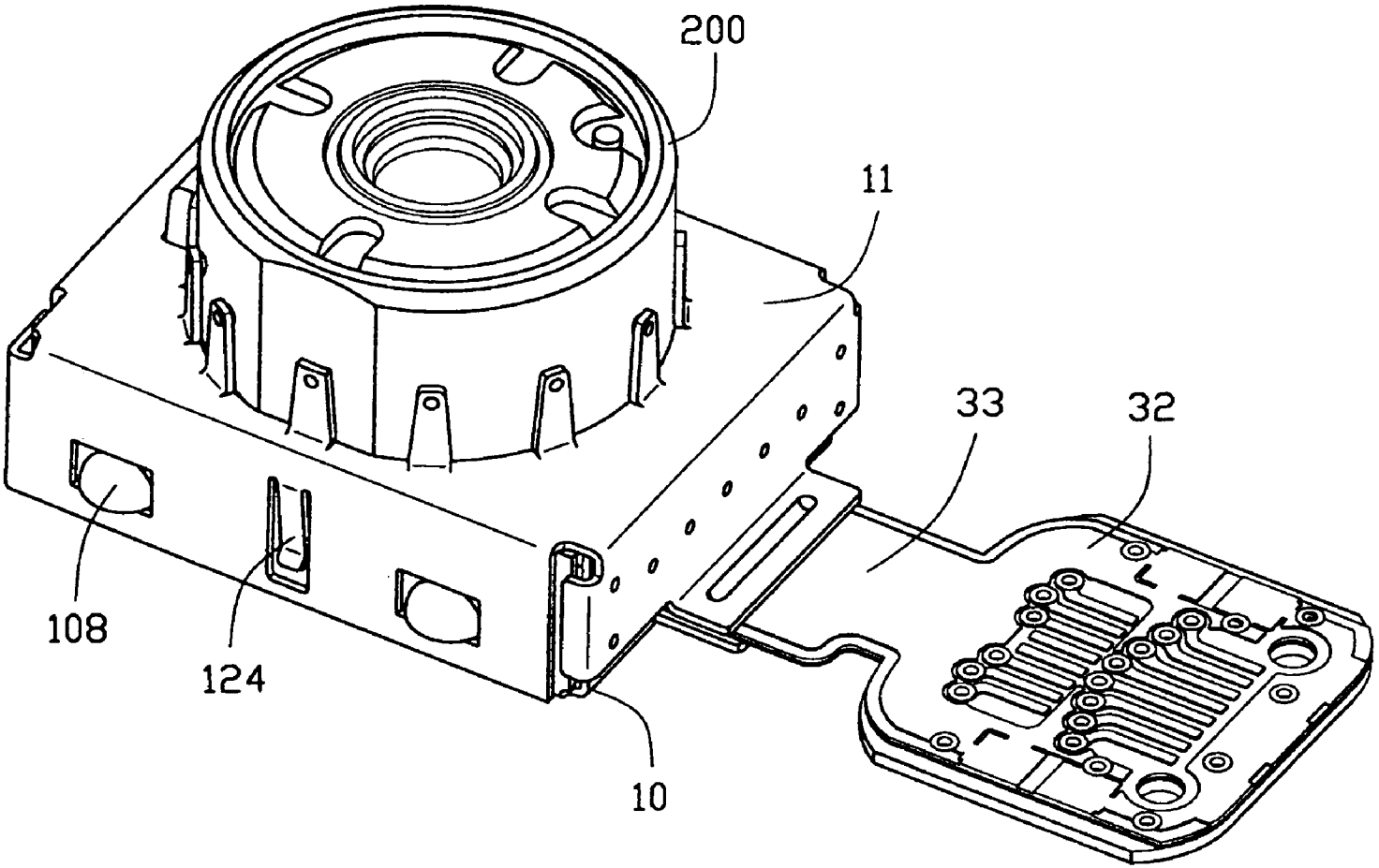
FIG. 1 is a perspective view of an electrical connector of the present invention which receives a module.

Reference will now be made to the drawing figures to describe the present invention in detail.

Figure 2:
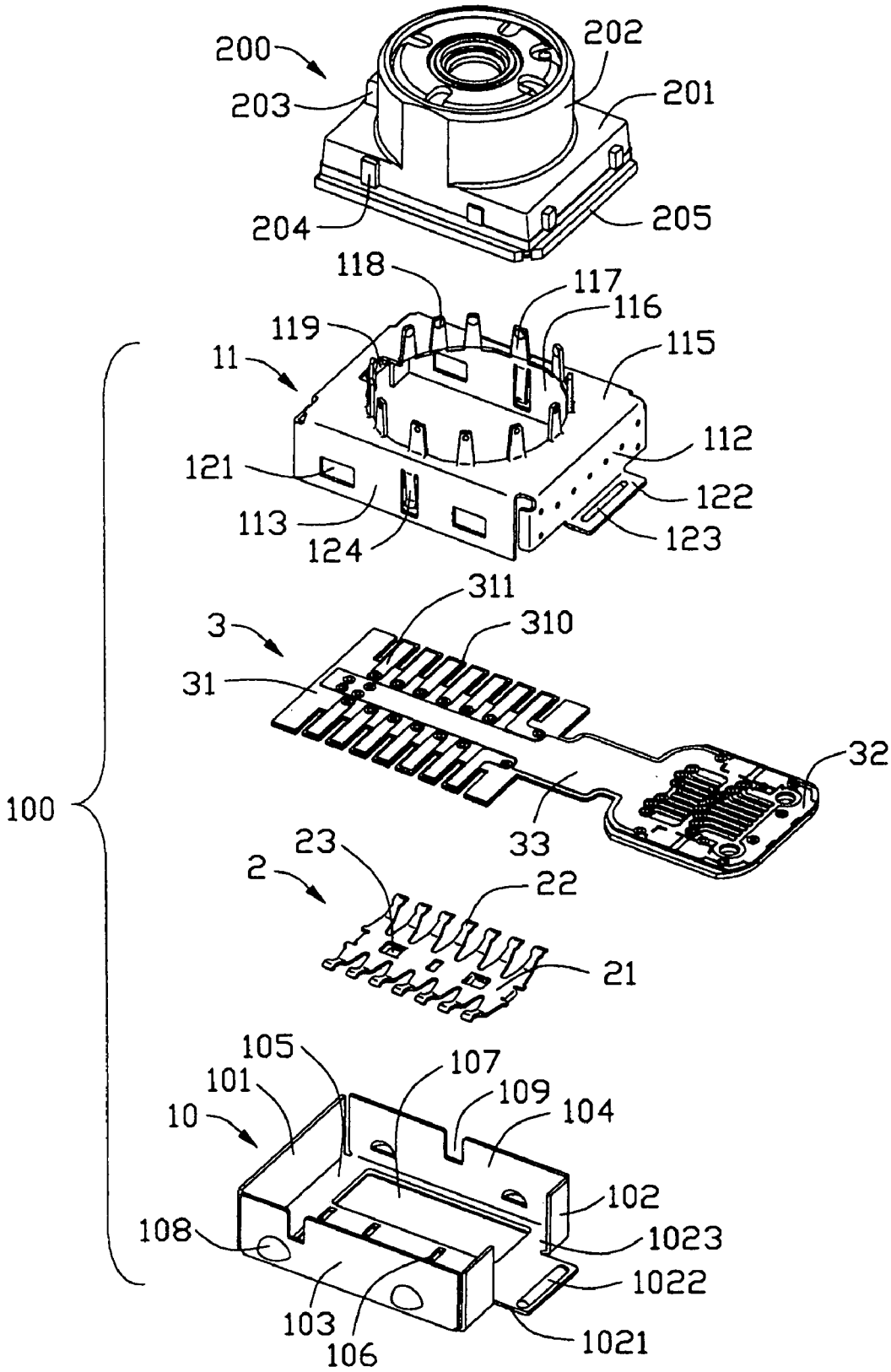
FIG. 2 is an exploded view of the electrical connector of the present invention.
Figure 3:
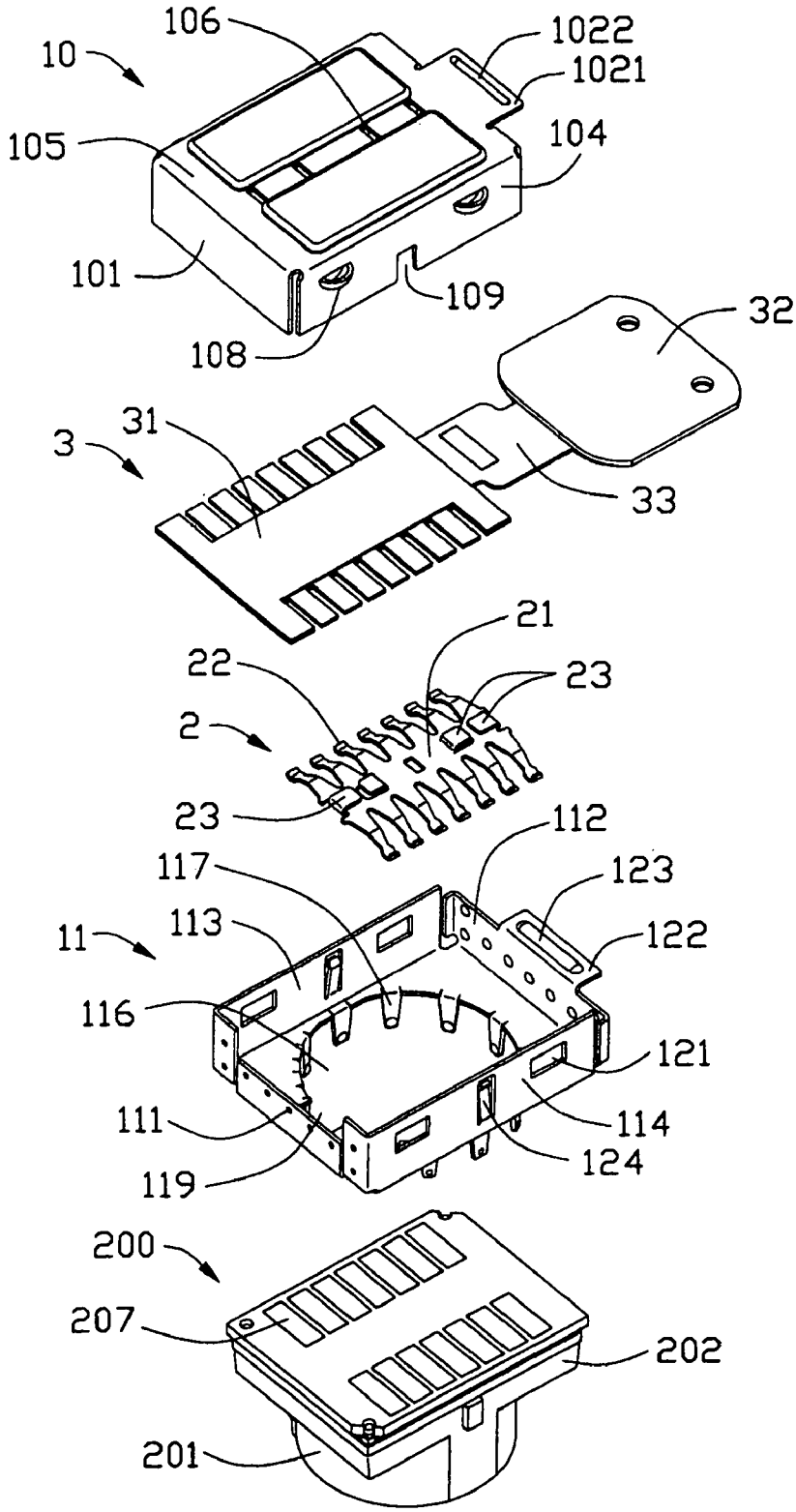
FIG. 3 is an another exploded view of the electrical connector shown in FIG. 1.

Referring to FIGS. 1, 2, and 3, an electrical connector 100 comprises a lower shield 10, an upper shield 11, a support element 2 and an FPC (Flexible Printed Circuit) 3. The connector 100 is adapted for receiving a camera module 200 therein. In an alternative embodiment, the electrical connector 100 may receive a memory module or the likes.

The lower shield 10 is substantially rectangular case, comprising a bottom wall 105 and four lateral walls 101, 102, 103, 104 extending upwardly from the bottom wall 105 to thereby define a rectangular receiving space (not labeled) therebetween. In an alternative embodiment, the receiving space also takes a circular shape, a quadrate shape or anther shape. The bottom wall 105 has four through holes 106 paralleled with each other defined on a central portion thereof and a pair of recesses 107 respectively defined on both sides of the through holes 106. The lateral walls 103, 104 each has a pair of protruding sections 108 projecting outwards from an outer surface thereof and being hollow inside. Each lateral wall 103, 104 defines thereon an anti-mismating indentation 109. The lateral wall 102 has a cutout 1023 defined on a middle portion thereof. A first strip 1021 extends outwards from an edge of the bottom wall 105 and projects through the cutout 1023. The first strip 1021 has a protrusion 1022 formed thereon.

The upper shield 11 comprises a top wall 115 and four lateral walls 111, 112, 113, 114 extending downwardly from the top wall 115 to thereby define a receiving space (not labeled) therebetween. The top wall 115 has a receiving hole 116 defined on a central portion thereof for extension of the module 200, a rectangular cutout 119 communicating with the receiving hole 116 and a plurality of holding tabs 117 protruding upwards along a periphery edge of the receiving hole 116. Each holding tab 117 is formed with a dimple 118 at an uppermost thereof. Each lateral wall 113, 114 defines thereon a pair of rectangular notches 121 corresponding to the module 200, and a resilient piece 124 stamped inwardly. The upper shield 11 has a second strip 122 perpendicularly extending from a bottom edge of the lateral wall 112. The second strip 122 is formed with a protrusion 123 protruded towards the lower shield 10.

The support element 2 is a fishbone configuration and comprises a main portion 21 formed with four holding blades 23. Two of the holding blades 23 are respectively formed on the two outer ends thereof and the other two of the holding blades 23 are approximately formed on the middle portion thereof. A plurality of resilient portions 22 extend from the both sides of the main portion 21 and are slantedly bent upwards the upper shield 11.

The FPC 3 comprises a rectangular first end portion 31, a second end portion 32 and a connecting portion connecting the first end portion 31, the second end portion 32 together. The first end portion 31 is formed with a bone portion 310 having a plurality of electronic circuits 311 provided therein. Each electronic circuit 311 has a conductive element (not labeled) exposed outside. The second end portion 32 is also provided with a plurality of electronic circuits (not labeled) thereon. The connecting portion 33 is formed with a plurality of grounding circuits (not labeled). The first portion 31 and the bottom wall 105 of the lower shield 10 have an equivalent size for allowing the first end portion 31 retained in the lower shield 10. The connecting portion 33 has a width equivalent to that of the cutout 1023 of the lateral wall 102 of the lower shield 10.

The camera module 200 comprises a rectangular base portion 201 having two rows of conductive strips 207 provided on a bottom surface thereof, a columned protruding portion 202 extending upwardly from a center of the base portion 201 and a rectangular anti-mismating block 203 formed on one side of the base portion 201. The base portion 201 has a pair of anti-mismating blocks 204 formed at a pair of opposite sides thereof corresponding to the anti-mismating indentations 109 of the lower shield 10.

Figure 4:
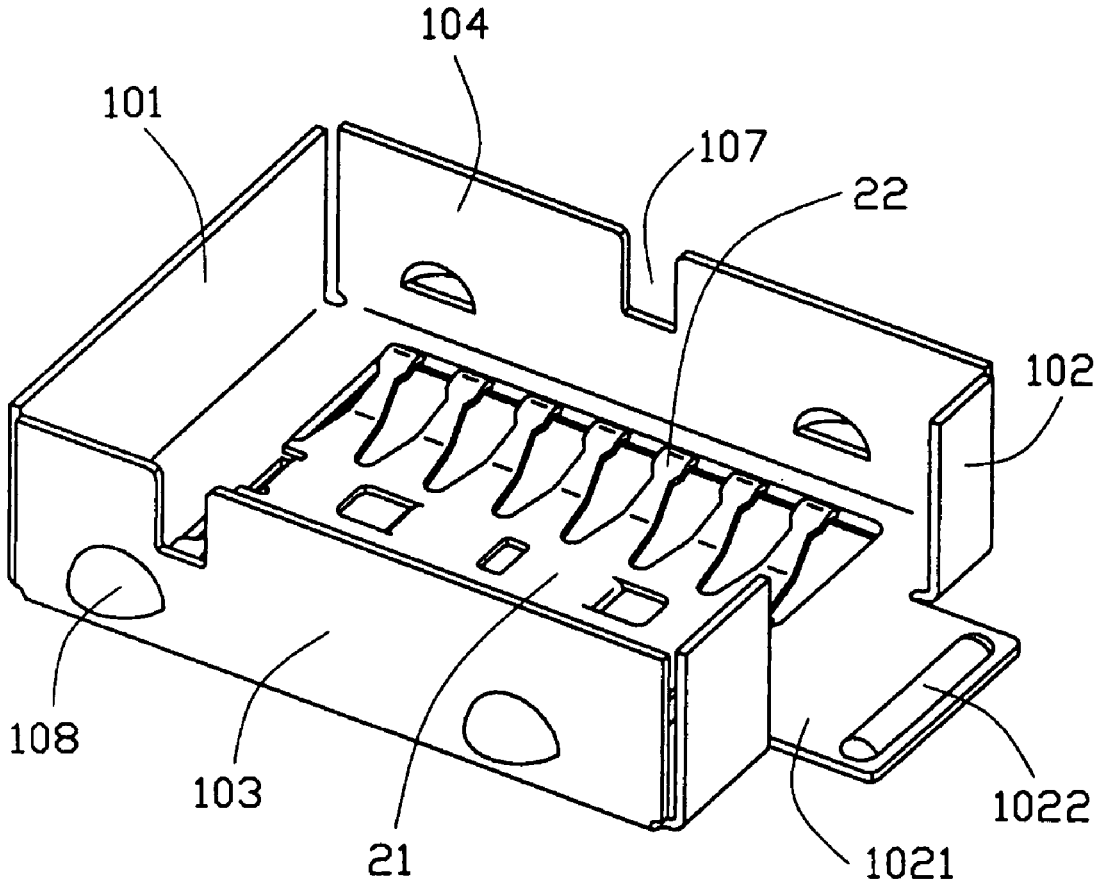
FIG. 4 is an assembled view of a lower shield and a support element.
Figure 5:
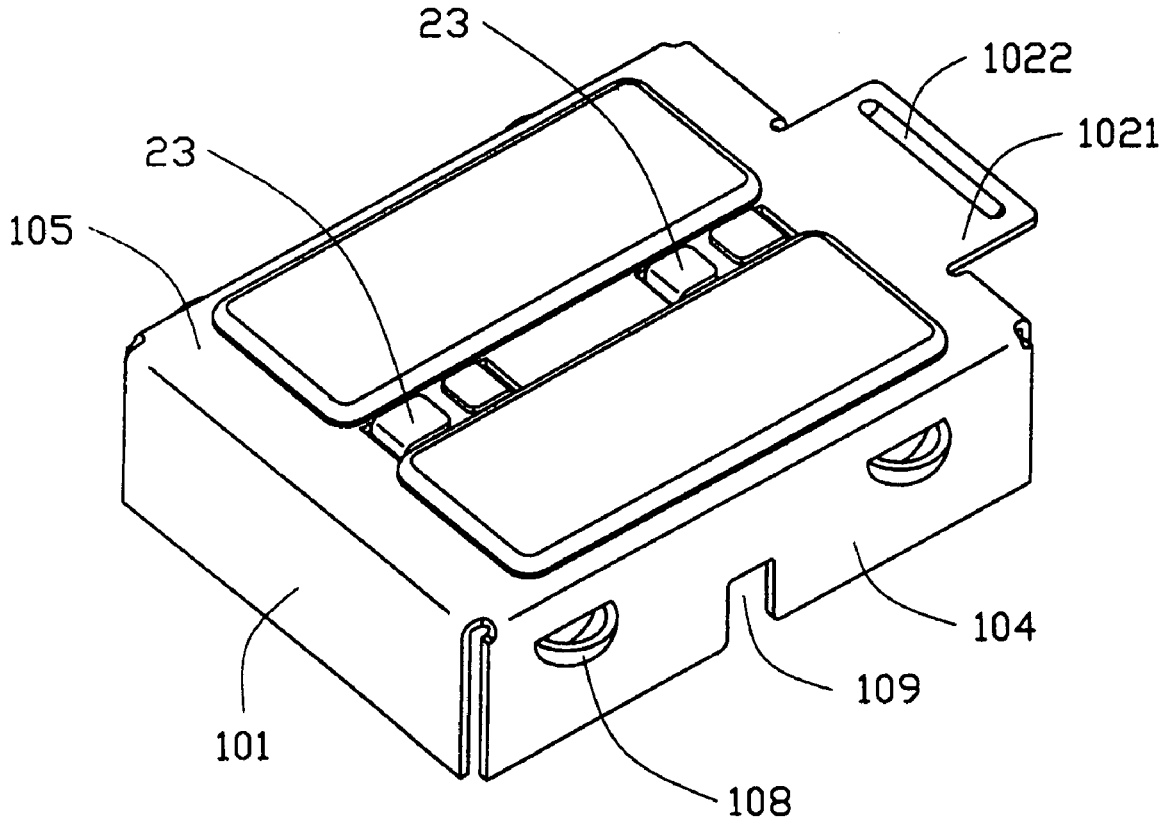
FIG. 5 is an another assembled view of the shield and the support element shown in FIG. 4.
Figure 6:
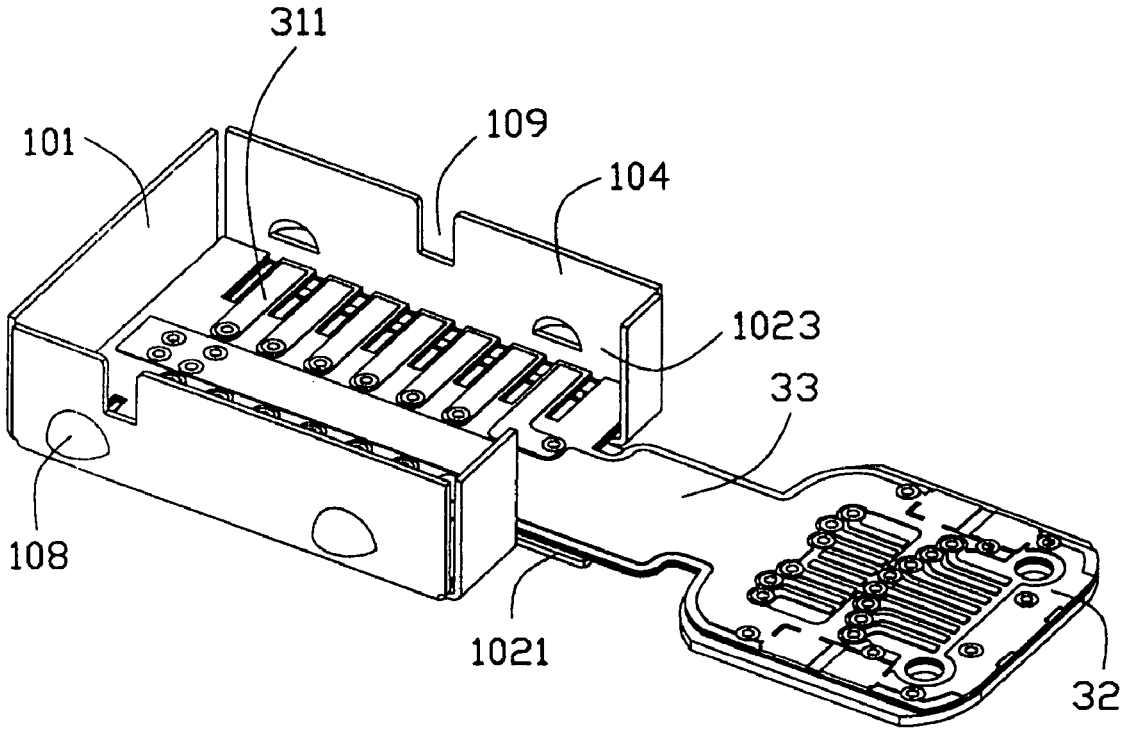
FIG. 6 is an assembled view of the electrical connector.
Figure 7:
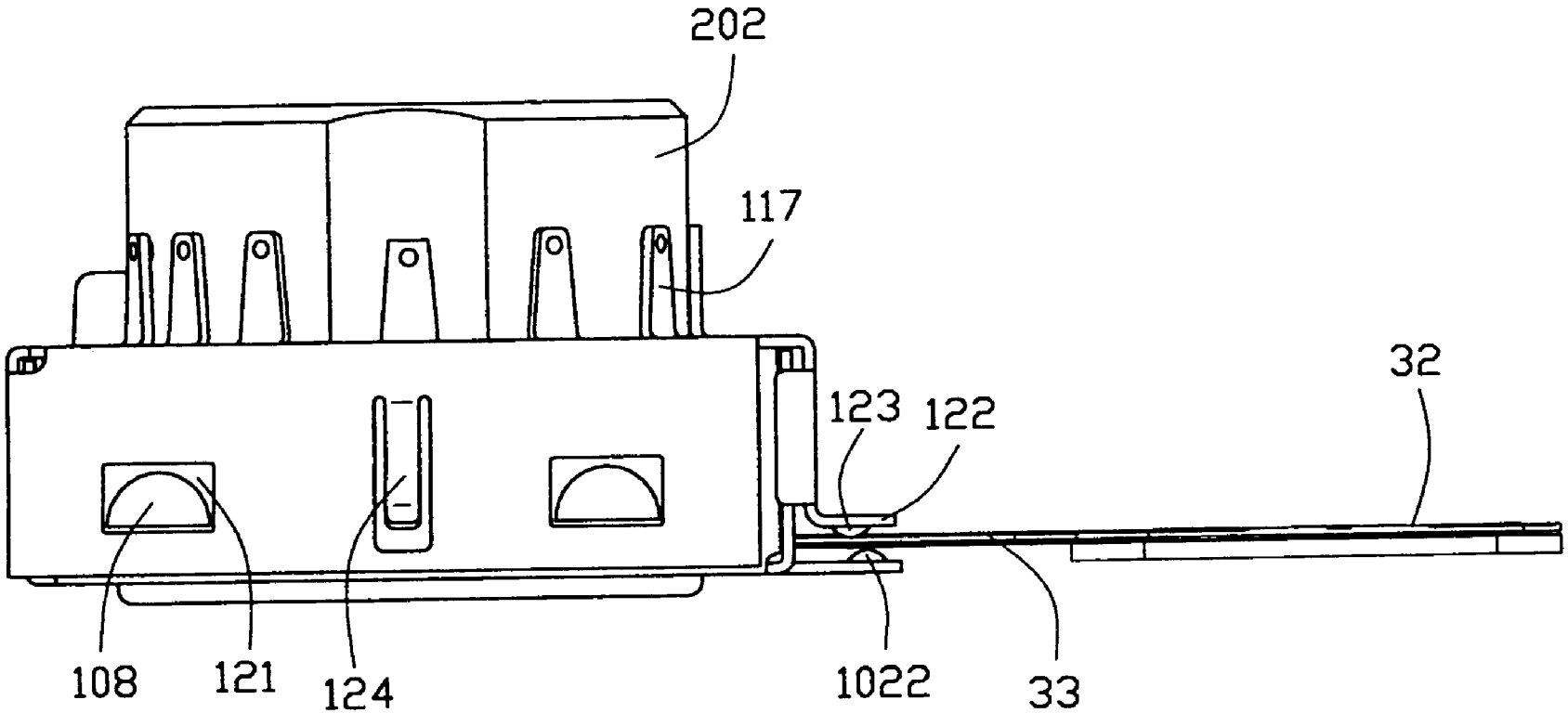
FIG. 7 is a side view of FIG. 1.

Referring to FIGS. 4, 5, 6, in assembly, the support element 2 is firstly mounted into the lower shield 10. The holding blades 23 are inserted into the corresponding through holes 106 of the lower shield 10. The resilient portions 22 are respectively received into the corresponding recesses 107. Secondly, the FPC 3 is assembled to the support element 2 and upwardly supported by the support element 2. The first end portion 31 is positioned above the support element 2 and is retained in the receiving space of the lower shield 10. The connecting portion 33 extends outwardly through the cutout 1023 of the lower shield 10. The module 200 is then inserted into the receiving space of the lower shield 10 with the conductive strips 207 thereof electrically engaging with the conductive circuits 311 of the FPC 3. The camera module 200 is electrically connected to the FPC 3. Finally, the upper shield 11 is assembled to the camera module 200, with the receiving hole 116 thereof receiving the protruding portion 202 and is buckled with the lower shield 10. The anti-mismating block 203 is engaged with the cutout 119 of the upper shield 11. The holding tabs 117 resist against the protruding portion 202, with the dimples 118 thereof having an interference with the outer surface of the protruding portion 202. The lower shield 10 is enclosed in the upper shield 11, with protruding sections 108 thereof engaging with the notches 121 of the upper shield 11. Thus, the resilient pieces 124 are respectively resisted against the lateral walls 103, 104. At the same time, the protrusions 123 and 1022 are respectively connected to the grounding circuits (not labeled) of the FPC 3. The first strip 1021 and the second strip 122 are thus electrically connected to the connecting portion 33 of the FPC 3.

The FPC 3 is mounted in the electrical connector 100 and electrically connects the module 200. Thus, the height of the whole structure could be minished and the space occupied by the structure would be small. The support element 2 is assembled to the connector 100 to resiliently uphold the FPC 3. Additionally, compared to the connector having a single shield, the connector 100 comprising the lower shield 10 and the upper shield 11 buckled with each other would make the connector 100 have a better anti-EMI function.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for receiving a module, comprising:

a shield defining a receiving space for receiving the module;

a flexible printed circuit received in the receiving space for electrically connecting the module; and a support element connected to the flexible printed circuit for maintaining an electrical connection between the flexible printed circuit and the module;

wherein the support element has an upwardly bent fishbone configuration and comprises a main portion and a plurality of resilient portions respectively extending from both sides of the main portion;

wherein the flexible printed circuit comprises a first end portion received in the receiving space, a second end portion respectively provided with a plurality of electronic circuits thereof and exposed outside of the shield, and a connecting portion connecting the first end portion and the second end portion; and wherein the connecting portion is narrower than the first end portion and the second end portion.

2. The electrical connector according to claim 1, wherein the shield comprises an upper shield and a lower shield buckled with the upper shield.

3. The electrical connector according to claim 2, wherein the support element has a plurality of holding blades formed thereon and wherein the lower shield has a plurality of through boles engaging the holding blades.

4. The electrical connector according to claim 3, wherein the lower shield has a cutout defined on a lateral wall thereof and the second end portion of the flexible printed circuit extends outwardly through the cutout.

5. The electrical connector according to claim 4, wherein the lower shield has a first strip formed thereon.

6. The electrical connector according to claim 5, wherein the upper shield has a second strip formed thereon.

7. The electrical connector according to claim 6, wherein the first strip and the second strip are respectively formed with a protrusion.

8. The electrical connector according to claim 7, wherein the two strips sandwich the connecting portion of the flexible printed circuit.

9. The electrical connector according to claim 8, wherein the upper shield comprises a top wall and a plurality of lateral walls extending downwardly from the top wall to thereby define a receiving space for enclosing the lower shield.

10. An electrical connector assembly comprising:

a detachable shielding defining a receiving space therein;

an electronic module received in the receiving space;

a removeable flexible circuit wit an inner portion received within the receiving space and engaged wit the electronic module, and an outer portion exposed outside of the said shield; and a support member defines a plurality of resilient fingers and a plurality of discrete circuits in alignment with said resilient fingers, respectively;

wherein said shield defines a pair of plates sandwiching therebetween an intermediate portion of the flexible circuit which is located between said inner portion and said outer portion; and wherein said intermediate portion is narrower than said inner portion and said outer portion.

11. The assembly as claimed in claim 10, wherein said support member cooperates wit the electronic module to tightly sandwich said inner portion therebetween.

12. The assembly as claimed in claim 10, wherein said shield includes upper and lower halves, and the pair of plates are respectively formed on said upper and lower halves.

* * * * *